US011414229B2

(12) United States Patent
Neber et al.

(10) Patent No.: US 11,414,229 B2
(45) Date of Patent: Aug. 16, 2022

(54) CLOSURE DEVICE FOR ADDING GAS TO AND CLOSING CONTAINERS THAT HAVE A FILLER OPENING

(71) Applicant: Bausch + Ströbel Maschinenfabrik Ilshofen GmbH + Co. KG, Ilshofen (DE)

(72) Inventors: Thomas Neber, Ilshofen (DE); Daniel Spieler, Crailsheim (DE); Tim Gögelein, Rot am See (DE)

(73) Assignee: BAUSCH + STRÖBEL MASCHINENFABRIK ILSHOFEN GMBH + CO. KG, Ilshofen (DE)

( * ) Notice: Subject to any disclaimer, the term of this patent is extended or adjusted under 35 U.S.C. 154(b) by 0 days.

(21) Appl. No.: 16/755,253

(22) PCT Filed: Nov. 7, 2018

(86) PCT No.: PCT/EP2018/080479
§ 371 (c)(1),
(2) Date: Apr. 10, 2020

(87) PCT Pub. No.: WO2019/101525
PCT Pub. Date: May 31, 2019

(65) Prior Publication Data

US 2020/0277091 A1 Sep. 3, 2020

(30) Foreign Application Priority Data

Nov. 27, 2017 (DE) ..... 10 2017 221 193.8

(51) Int. Cl.
*B65B 31/04* (2006.01)
*B65B 3/00* (2006.01)
(Continued)

(52) U.S. Cl.
CPC ..... *B65B 31/046* (2013.01); *B65B 3/003* (2013.01); *B67B 1/00* (2013.01); *B67C 3/222* (2013.01)

(58) Field of Classification Search
CPC ..... B67C 3/222; B65B 31/046; B65B 3/003; B67B 1/00
See application file for complete search history.

(56) References Cited

U.S. PATENT DOCUMENTS 2,842,916 A * 7/1958 Parodi ..... B65B 31/046 53/88
3,356,510 A 12/1967 Barnby
(Continued)

FOREIGN PATENT DOCUMENTS

DE 102006061498 A1 7/2008
EP 2669200 A1 12/2013
(Continued)

OTHER PUBLICATIONS

German Application No. DE102017221193.8, "German Search Report", dated Jul. 10, 2018, 7 pages.
(Continued)

*Primary Examiner* — Andrew M Tecco
*Assistant Examiner* — Nicholas E Igbokwe
(74) *Attorney, Agent, or Firm* — Kilpatrick Townsend & Stockton LLP

(57) ABSTRACT

The invention relates to a closing device for closing containers which have a filling opening, such as bottles or cans, comprising a positioning apparatus for arrangement of a container to be closed into a position for closing, a flushing apparatus with a nozzle device for blowing in flushing gas, in particular inert gas, into a container to be closed though its filling opening prior to closure, a closing element setting apparatus for attachment of a closing element to a container
(Continued)

to be closed in a position which closes its filling opening and thus the container and a control apparatus.

12 Claims, 1 Drawing Sheet

(51) Int. Cl.
*B67B 1/00* (2006.01)
*B67C 3/22* (2006.01)

(56) References Cited

U.S. PATENT DOCUMENTS 5,060,449 A * 10/1991 Klarl ..... B67C 3/222 53/88
6,691,747 B1 * 2/2004 Marcus ..... B65B 31/041 141/4
2005/0086909 A1 * 4/2005 Krulitsch ..... B67C 3/004 53/167
2006/0231156 A1 * 10/2006 Marcus ..... B65B 31/041 141/64
2008/0250758 A1 * 10/2008 Rauschnabel ..... B67B 3/10 53/487

FOREIGN PATENT DOCUMENTS

| | | | | | |
|---|---|---|---|---|---|
| FR | 2826948 | A1 | | 1/2003 | |
| JP | 02139313 | A | | 5/1990 | |
| JP | 2004042994 | A | | 2/2004 | |
| JP | 2006315733 | A | * | 11/2006 | ..... B67C 3/222 |
| JP | 2006315733 | A | | 11/2006 | |
| JP | 2007161347 | A | | 6/2007 | |
| WO | 2016144052 | A1 | | 9/2016 | |

OTHER PUBLICATIONS

International Application No. PCT/EP2018/080479, "International Search Report and Written Opinion", dated Mar. 15, 2019, 16 pages.

* cited by examiner

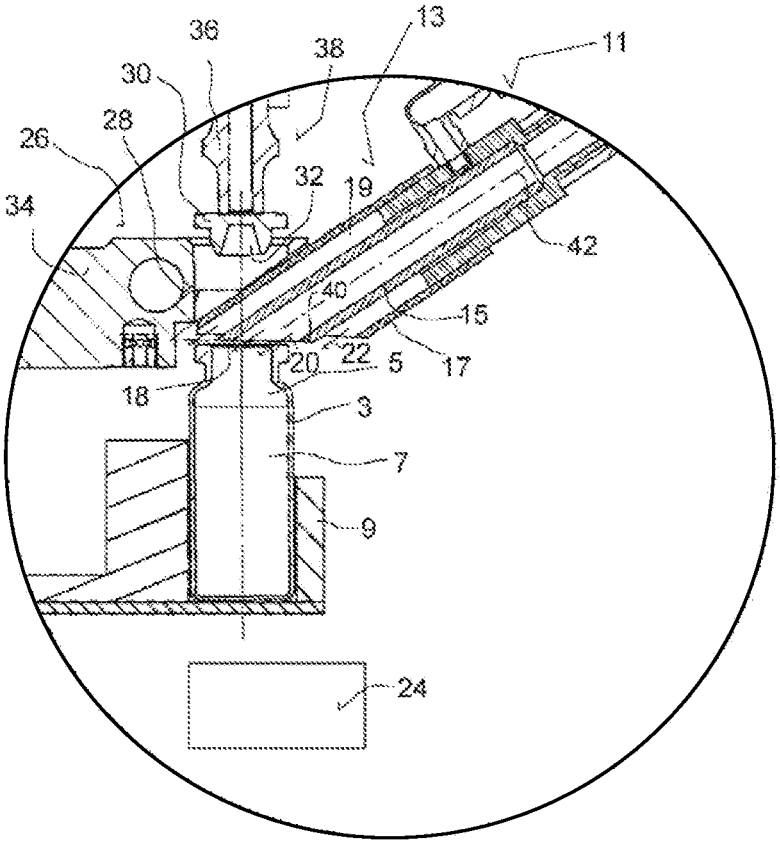
36
38
13
11
30
28
26
32
19
34
42
40
15
22
20
5
17
18
3
7
9
24
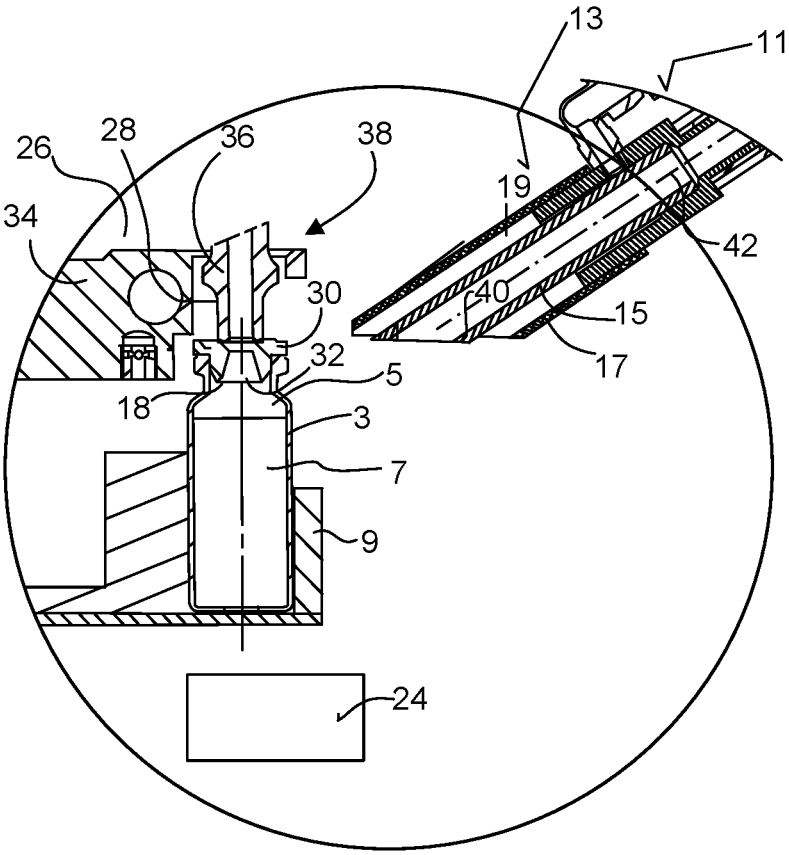
13
11
28
36
38
26
19
34
42
30
40
15
32
17
5
18
3
7
9
24

CLOSURE DEVICE FOR ADDING GAS TO AND CLOSING CONTAINERS THAT HAVE A FILLER OPENING

CROSS REFERENCE TO RELATED APPLICATION

This application claims priority to German Patent Application No. 10 2017 221 193.8, filed in Germany on Nov. 27, 2017, the entire contents of which are hereby incorporated herein by this reference.

The invention relates to a closing device for closing in particular automatically filled containers which have a filling opening, such as bottles, cans, vials, cartridges or ampoules. The closing device comprises

- a positioning apparatus for arrangement of a container to be closed into a position for closing,
- a flushing apparatus with a nozzle device for blowing in flushing gas into a container to be closed though its filling opening prior to closure,
- a closing element setting apparatus for attachment of a closing element to a container to be closed in a position which closes its filling opening and thus the container and
- a control apparatus.

Closing devices of the type considered here are used, for example, in the chemical industry and in the pharmaceutical industry in order to close corresponding containers after the filling thereof with, for example, oxygen-sensitive, liquid chemicals or pharmaceuticals. It is already known, prior to closing such filled containers, to flush the headspace volume of the containers with inert gas, for example, nitrogen, as flushing gas in order to displace oxygen out of the headspace.

There exist such closing devices in the case of which nozzles of a nozzle device are positioned obliquely on the openings of the containers, while the inert gas flows into the container. The nozzles are retracted from the container openings at the end of the respective flushing gassing in order to make space for the operation of a closing element setting apparatus which attaches a respective closure, for example, a respective rubber stopper, to the containers to be closed, i.e. introduces them into the filling opening in order to close the corresponding container. The flushing of the containers by means of the flushing apparatus and where applicable also the closing of the containers can be carried out where applicable during a transport movement of the containers, wherein the nozzles and, where applicable, the closing setting means are also moved in the transport direction. The corresponding elements of the closing device can follow, for example, a step cycle with the containers and subsequently reset at the subsequent machine cycle.

It is also already known that the atmospheric oxygen which is located in a typically present lower recess of a closing element positioned ready for the closing process is also introduced into the container so that, as a result of this, the residual oxygen in the closed container is correspondingly increased. In order to remedy this as far as possible, additional flushing nozzles are known to be used which blow inert gas, for example, obliquely from the bottom into the closing element recesses in order to displace the air located therein.

It was possible to achieve a reduction in the residual oxygen in the headspace of the treated containers to a few percent by volume, for example, 2 percent by volume with known devices of the above-mentioned type.

The invention relates more precisely to a closing device with the features of the preamble of claim 1, namely a closing device for closing containers which have a filling opening, such as bottles or cans, comprising

- a positioning apparatus for arrangement of a container to be closed into a position for closing,
- a flushing apparatus with a nozzle device for blowing in flushing gas into a container to be closed though its filling opening prior to closure,
- a closing element setting apparatus for attachment of a closing element to a container to be closed in a position which closes its filling opening and thus the container and
- a control apparatus, wherein the nozzle device has a central nozzle arrangement and a peripheral nozzle arrangement surrounding the central nozzle arrangement, wherein the nozzle device and a container to be closed can be positioned relative to one another by means of the positioning apparatus in a flushing position so that the central nozzle arrangement is aligned at least primarily to its filling opening for the introduction of flushing gas into the container and the peripheral nozzle arrangement aims at a peripheral region of the filling opening, so that both the filling opening and also its periphery are exposed to a flushing gas flow when the nozzle device outputs flushing gas.

Such generic closing devices are known, for example, from JP H02 139313 A and US 2006/231156 A1. Against this background, the object of the present invention lies in improving the generic closing device such that, after the flushing process and prior to the complete closure of the container, as little as possible atmospheric oxygen can reach the container through the filling opening. This object is achieved by a closing device with the features of claim 1.

Inert gas, e.g. nitrogen, is preferably possible as the flushing gas.

The central nozzle arrangement and the peripheral nozzle arrangement jointly form a gas outflow region which is larger than the filling opening of a corresponding container to be closed. During the intended operation of the flushing apparatus, on one hand, flushing gas is blown from the central nozzle arrangement into the filling opening of the corresponding container. At the same time, the peripheral nozzle arrangement outputs flushing gas into the region of the periphery of the filling opening. This has the result that any suction effect of the central nozzle arrangement, during blowing of the flushing gas into the filling opening of the corresponding container, does not introduce air and thus undesired oxygen from the lateral surroundings into the filling opening, rather flushing gas, which is present in any event, of the peripheral nozzle arrangement. The very good results achieved with the closing device according to the invention are good evidence of this. It was thus possible to identify a residual oxygen content of $<0.5\%$ in the headspace by means of the closing device according to the invention of the closed containers.

According to one preferred embodiment of the closing device according to the invention, the central nozzle arrangement and the peripheral nozzle arrangement are in each case formed as a tube element, wherein the tube element forming the central nozzle arrangement is received in particular concentrically in the tube element forming the peripheral nozzle arrangement. Such a construction can be produced at low cost with simple means and also has the advantage that an expedient flushing gas supply during flushing of corresponding containers is possible. In a further embodiment, the peripheral nozzle arrangement can have several peripheral nozzles which annularly surround the central nozzle arrangement. Where applicable, the central nozzle arrangement can also have several nozzles as a bundle.

The flushing gas flow of the central nozzle arrangement and the flushing gas flow of the peripheral nozzle arrangement can preferably be controlled separately in order to set optimum conditions during flushing.

According to the invention, the position for closing and the flushing position for a respective container to be flushed and closed correspond to one another, wherein the nozzle device is movable relative to a container introduced by means of the positioning apparatus into the position for closing between the flushing position and a retracted position. In the flushing position, it is positioned with its flushing gas outlet end opposite the filling opening of the container overlapping this. In this manner, using corresponding drives of the closing device, the subsequent process of attaching the closing element, therefore closing of the container, can be performed quickly once the nozzle device has at least as far as possible performed its movement into the retracted position. It is thus possible to the greatest extent to prevent atmospheric oxygen from once again reaching the container through the filling opening after the flushing process and prior to the complete closure of the container.

In the case of one embodiment of the invention, the nozzle apparatus is advantageously configured such that it is oriented in the flushing position obliquely with respect to the filling opening of a container positioned in position for closing and to be flushed. Such a nozzle device can be quickly moved on the shortest path, for example, by lateral pivoting or/and lateral pulling away from its flushing position into the retracted position.

It can furthermore also be provided that the nozzle apparatus is chamfered at its flushing gas outlet end relative to the tube element longitudinal axis so that in the flushing position of the nozzle device the flushing gas outlet end lies at least approximately in a plane which extends parallel to the upper edge of the filling opening of a respective container positioned in position for closing. Such an arrangement enables a yet further improved flow guidance of the flushing gas during flushing of a container.

The closing element setting device can, according to one embodiment of the invention, have a closing element holder which is movable between a retracted passive position and an advanced closing element output position, which closing element holder can be, for example, a stopper placer which can push a stopper as a closing element into the filling opening of a container to be closed.

The closing device can preferably be controlled by means of the control apparatus so that the movement of the closing element holder out of its retracted passive position into the advanced closing element output position and the movement of the nozzle device out of the flushing position into its retracted position are performed simultaneously at least in regions. This also serves to minimize a period of time between the targeted flushing and the subsequent attachment of the closing element to a corresponding container so that hardly any air can flow into the container in this period of time.

According to one further development of the invention, the closing device has an additional nozzle device with at least one flushing nozzle for outputting flushing gas in the direction of the closing element holder, so that the flushing nozzle can blow flushing gas onto a closing element which is provided by the closing element holder for a current closing process.

This measure serves to prevent atmospheric oxygen which can be located in a recess of the corresponding closing element from also being introduced into the container to be closed. The additional nozzle device serves to displace and replace such atmospheric oxygen residues with flushing gas so that flushing gas but where possible no oxygen can be introduced into a corresponding container when putting in place the closing element with a corresponding closing element.

According to a further preferred embodiment of the invention, the positioning apparatus is formed to arrange a group of containers to be closed into a position for closing, wherein the closing element setting apparatus is furthermore formed to attach closing elements to a corresponding group of containers to be closed in a position which closes the filling openings. The nozzle device of the flushing apparatus is provided multiple times with the formation of a group of nozzle devices of the same type.

An exemplary embodiment of the invention is explained in greater detail below with reference to the single FIGURE.

The FIGURE shows a partially schematic, cut-out detailed sectional representation of a region of the closing device in which the flushing of a corresponding container with inert gas and the closing of the container take place.

In the FIGURE, a flask 3 is apparent as a container, which flask is filled up to a headspace volume 5 with an oxygen-sensitive liquid pharmaceutical 7.

Flask 3 is located in a positioning apparatus 9 of the closing device and has been introduced by means of this positioning apparatus 9 into the shown position for closing, wherein this position for closing also corresponds to the flushing position in which, for example, inert gas is introduced as flushing gas into headspace 5 of flask 3.

A flushing apparatus 11, of which substantially a nozzle device 13 in its flushing position relative to flask 3 is apparent in the FIGURE, serves this purpose.

Nozzle device 13 has as a central nozzle arrangement an inner cylindrical tube element 15 which, in the flushing position, is directed substantially at filling opening 18 of flask 3 in order to blow in the inert gas there.

Nozzle device 13 further comprises as a peripheral nozzle arrangement a cylindrical tube element 17 which coaxially surrounds tube element 15 and which also serves to discharge inert gas. Inert gas can thus be blown out of intermediate space 19 between central tube element 15 and peripheral tube element 17 into the periphery of filling opening 18 of flask 3 in order to displace air and thus the atmospheric oxygen there, so that it is not sucked into filling opening 18 as a result of the sucking actions during the flushing process.

According to a modified embodiment of the invention, tube element 17 and/or tube element 15 can be widened in a funnel-shaped manner at the output of nozzle device 13.

Gas flow 20 of central tube element 15, which is directed at filling opening 18 of flask 3 and gas flow 22 delimited at the outside by peripheral tube element 17 can be controlled separately from one another in terms of their strength. Control is carried out by a control apparatus 24 which also controls the other functions of the closing device.

As a result of the described process, during flushing of the flask, it was possible to reduce the residual oxygen content in headspace volume 5 of flask 3 to an extremely low value of <0.5%.

An additional nozzle device 26 with at least one additional flushing nozzle 28 serves as a further measure to minimize the residual oxygen content in flask 3, which additional flushing nozzle 28 in the case of the example of inert gas is directed in the direction of a closing element provided for the subsequent closing process in the form of a stopper 30 so that the flushing gas reaches lower recess 32 of stopper 30 and can displace air there.

Frame 34 of additional nozzle device 26 has such a structure that regions 5, 32 to be flushed are well screened from the entry of air towards the outside, when the flask 3 and nozzle device 13 are in the shown flushing position. In this manner, air is prevented from being able to subsequently flow from the outside in critical quantities to the flushed regions.

Stopper 30 is located at the lower end of a push-in plunger 36 as a closing element holder of a closing element setting apparatus 38. In the FIGURE, push-in plunger 36 is shown in a retracted passive position from which it can be moved into an advanced closing element output position in order to push stopper 30 into filling opening 18 of flask 3. Before this can happen, however, nozzle device 13 must first be moved out of the path between shown stopper 30 and filling opening 18 of flask 3. This is performed very quickly after the flushing process in that the nozzle device is moved laterally using an at least approximately horizontal movement component to the right in the FIGURE by means of a corresponding drive device (not shown) into a retracted position. After or, where applicable, already during this retraction movement of nozzle device 13, a drive apparatus of closing element setting apparatus 38 moves push-in plunger 36 out of the retracted passive position shown in the FIGURE into an advanced closing element output position, in which it pushes stopper 30 into filling opening 18 of flask 3. Flask 3 is thereafter tightly closed and has an in any event extremely low residual oxygen content in its headspace 5.

It should also be noted that nozzle device 13, in its flushing position, is oriented obliquely to the filling opening of flask 3 positioned in position for closing and to be flushed. It should furthermore be noted that nozzle device 13 is chamfered at its flushing gas outlet end relative to tube element longitudinal axis 42 so that flushing gas outlet end 40, in the flushing position of nozzle device 13, lies at least approximately in a plane which extends parallel to the upper edge of filling opening 18 of flask 3. These measures serve on one hand to improve the flushing effect of flask 3, on the other hand quicker movability of nozzle device 13 out of the spatial region between stopper 30 and filling opening 18.

The invention claimed is:

1. Closing device for closing containers which have a filling opening, the closing device comprising:

a positioning apparatus configured to arrange a container in a closing position, a flushing apparatus with a nozzle device configured to blow flushing gas into the container through the filling opening of the container prior to closure and while the container is positioned in the closing position, a closing element setting apparatus configured to attach a closing element into the filling opening of the container while the container is positioned in the closing position, and a control apparatus, wherein the nozzle device has a central nozzle arrangement and a peripheral nozzle arrangement surrounding the central nozzle arrangement, wherein the nozzle device is movable relative to the container positioned in the closing position in a movement between a flushing position and a retracted position, wherein, in the flushing position of the nozzle device, the central nozzle arrangement is aligned at least primarily with the filling opening of the container for the introduction of flushing gas into the container and the peripheral nozzle arrangement aims at a peripheral region of the filling opening so that both the filling opening and a periphery of the filling opening are exposed to a flushing gas flow when the nozzle device outputs the flushing gas, and wherein the control apparatus is configured to control the movement of the nozzle device and a movement a closing element holder of the closing element setting apparatus relative to the container while the contained is positioned in the closing position, and wherein the movement of the nozzle device and the movement of the closing element holder at least partially overlap in time.

2. Closing device according to claim 1, characterised in that the central nozzle arrangement and the peripheral nozzle arrangement are each formed as a tube element, wherein the tube element which forms the central nozzle arrangement is received in particular concentrically in the tube element which forms the peripheral nozzle arrangement.

3. Closing device according to claim 1, characterised in that the nozzle device is oriented in the flushing position obliquely with respect to the filling opening of the container positioned in the closing position.

4. Closing device according to claim 3, characterised in that the nozzle device is chamfered at its flushing gas outlet end relative to a tube element longitudinal axis, so that the flushing gas outlet end lies in the flushing position of the nozzle device at least approximately in a plane which extends parallel to an upper edge of the filling opening of a respective the container positioned in the closing position.

5. Closing device according to claim 1, characterised in that the nozzle device is pivotable in a horizontal plane between the retracted position and the flushing position.

6. Closing device according to claim 1, characterised by an additional nozzle device with at least one flushing nozzle configured to output additional flushing gas in the direction of the closing element holder of the closing element setting apparatus so that the flushing nozzle can blow the flushing gas onto the closing element.

7. Closing device according to claim 1, characterised in that a flushing gas flow output by the central nozzle arrangement and a flushing gas flow output by the peripheral nozzle arrangement can be controlled separately from one another.

8. Closing device according to claim 1, characterised in that the positioning apparatus is formed for arrangement of one or more containers to be closed into the closing position, that the closing element setting apparatus is formed to attach one or more closing elements to corresponding one or more containers positioned in the closing position, and that the nozzle device of the flushing apparatus is provided one or more times.

9. Closing device according to claim 1, wherein the movement of the closing element holder comprises a vertical movement, and wherein the closing element setting apparatus comprises a plunger as the closing element holder that is movable relative to the container positioned in the closing position in the vertical movement between a retracted passive position in which the closing element is held by the closing element holder so that it is aligned with and positioned above the filling opening of the container and an advanced closing element output position in which the closing element holder pushes the closing element into the filling opening of the container in order to close the filling opening.

10. Closing device according to claim 9, wherein the movement of the nozzle device comprises a horizontal movement, and wherein the control apparatus is configured to control the horizontal movement of the nozzle device and the vertical movement of the closing element holder by at least:

positioning, in the flushing position of the nozzle device, a flushing gas output end of the nozzle device below the closing element holder in its retracted passive position, retracting the closing element holder from the advanced closing element output position when the nozzle device approaches the flushing position, so that, when the nozzle device has reached the flushing position, the closing element holder has left the advanced closing element output position, and performing the vertical movement of the closing element holder out of the retracted passive position into the advanced closing element output position and the horizontal movement of the nozzle device out of the flushing position into the retracted position at least partly in a simultaneous manner while the container remains in the closing position during flushing and closing of the container.

11. A method comprising:

positioning a container in a closing position of a positioning apparatus;

blowing, by at least using a nozzle device of a flushing apparatus and while the container is positioned in the closing position, flushing gas into the container through a filling opening of the container, wherein using the nozzle device comprises:

moving the nozzle device relative to the container in a movement between a retracted position and a flushing position, and aligning, when the nozzle device is in the flushing position, a central nozzle arrangement of the nozzle device at least primarily with the filling opening of the container and positioning, when the nozzle device is in the flushing position, a peripheral nozzle arrangement of the nozzle device so that the peripheral nozzle arrangement aims at a peripheral region of the filling opening; and attaching, by at least using a closing element setting apparatus and while the container is positioned in the closing position, a closing element into the filling opening of the container, wherein using the closing element setting apparatus comprises a movement of a closing element holder of the closing element setting apparatus relative to the container, wherein the movement of the nozzle device and the movement of the closing element holder at least partially overlap in time.

12. A non-transitory computer-readable storage medium storing instructions that, upon execution on a system, cause the system to perform operations comprising:

positioning a container in a closing position of a positioning apparatus;

blowing, by at least using a nozzle device of a flushing apparatus and while the container is positioned in the closing position, flushing gas into the container through a filling opening of the container, wherein using the nozzle device comprises:

moving the nozzle device relative to the container in a movement between a retracted position and a flushing position, and aligning, when the nozzle device is in the flushing position, a central nozzle arrangement of the nozzle device at least primarily with the filling opening of the container and positioning, when the nozzle device is in the flushing position, a peripheral nozzle arrangement of the nozzle device so that the peripheral nozzle arrangement aims at a peripheral region of the filling opening; and attaching, by at least using a closing element setting apparatus and while the container is positioned in the closing position, a closing element into the filling opening of the container, wherein using the closing element setting apparatus comprises a movement of a closing element holder of the closing element setting apparatus relative to the container, wherein the movement of the nozzle device and the movement of the closing element holder at least partially overlap in time.

* * * * *